US005895145A

United States Patent [19]

Yamada

[11] Patent Number: 5,895,145

[45] Date of Patent: Apr. 20, 1999

[54] PC-CARTRIDGE FOR ASSEMBLING BRAKING MECHANISM IN IMAGE FORMATION APPARATUS

[75] Inventor: Shinichi Yamada, Niigata, Japan

[73] Assignee: NEC Corporation, Tokyo, Japan

[21] Appl. No.: 08/959,991

[22] Filed: Oct. 29, 1997

[30] Foreign Application Priority Data

Oct. 30, 1996 [JP] Japan ..... 8-288612

[51] Int. Cl.[6] ..... G03G 15/00

[52] U.S. Cl. ..... 399/116; 399/167

[58] Field of Search ..... 399/116, 117, 399/167, 159

[56] References Cited

U.S. PATENT DOCUMENTS

| | | | |
|---|---|---|---|
| 4,167,321 | 9/1979 | Miyashita et al. | 399/167 |
| 5,420,664 | 5/1995 | Miwa et al. | 399/167 |
| 5,666,596 | 9/1997 | Yoo | 399/159 X |
| 5,722,013 | 2/1998 | Nagase et al. | 399/117 X |
| 5,761,580 | 6/1998 | Harada et al. | 399/167 |

FOREIGN PATENT DOCUMENTS

| | | |
|---|---|---|
| 52-69335 | 6/1977 | Japan . |
| 54-96646 | 12/1977 | Japan . |
| 60-36647 | 3/1985 | Japan . |
| 2-253271 | 10/1990 | Japan . |
| 3-241362 | 10/1991 | Japan . |
| 4-55043 | 2/1992 | Japan . |
| 5-11521 | 1/1993 | Japan . |
| 5-45949 | 2/1993 | Japan . |
| 09-101639 | 4/1997 | Japan . |

*Primary Examiner*—Arthur T. Grimley
*Assistant Examiner*—Sophia S. Chen
*Attorney, Agent, or Firm*—Sughrue, Mion, Zinn Macpeak & Seas, PLLC

[57] ABSTRACT

A PC-cartridge of an image formation apparatus prevents deterioration of printing quality, occurrence of noise, difficulty of assembly, or extent of necessary space caused by a rotation braking mechanism of the photosensitive drum thereof. A braking mechanism which has positioning part located on the same shaft as the rotational center of the photosensitive drum is assembled on the inside of the drum gear.

4 Claims, 3 Drawing Sheets

PC-CARTRIDGE FOR ASSEMBLING BRAKING MECHANISM IN IMAGE FORMATION APPARATUS

BACKGROUND OF THE INVENTION

The present invention relates to an electrophotographic cartridge (hereinafter referring to as PC-cartridge) of an image formation apparatus. Particularly, the present invention relates to a PC-cartridge of an image formation apparatus having braking mechanism for reducing evenness of rotation for a photosensitive drum.

DESCRIPTION OF THE PRIOR ART

Formerly, in this kind of PC-cartridge of the image formation apparatus, there are following examples as the braking mechanism of the photosensitive drum.

A. The Japanese Patent Application Laid-Open No. SHO 52-69335 discloses the apparatus in which it causes a braking member to mount at a portion of halfway of transferring mechanism for transferring rotation of a rotational drum.

B. The Japanese Utility Model Application Laid-Open No. SHO 54-96646 discloses an apparatus in which the braking member is in contact with part of the photosensitive drum or part of the rotative section rotating with the photosensitive drum.

C. The Japanese Utility Model Application Laid-Open No. SHO 60-36647 discloses the apparatus in which the braking member is mounted between the side of the photosensitive drum and the side of the supporting frame.

D. The Japanese Patent Application Laid-Open No. HEI 2-253271 discloses an apparatus in which the braking member is placed between the photosensitive body and the photosensitive body holder or between the photosensitive body and the image forming unit.

E. The Japanese Patent Application Laid-Open No. HEI 3-241362 discloses an apparatus in which the braking member contacts part of the photosensitive drum.

F. The Japanese Patent Application Laid-Open No. HEI 4-55043 discloses an apparatus in which it causes the brake-pad to support by the elastic body to contact with inner peripheral surface of the drum.

G. The Japanese Patent Application Laid-Open No. HEI 5-11521 discloses an apparatus in which the belt shaped braking member is wound around the outer peripheral surface of the photosensitive body.

H. The Japanese Patent Application Laid-Open No. HEI 5-45949 discloses an apparatus in which the braking member is mounted on the end section of the longitudinal direction of outer peripheral surface of the photosensitive body.

However, in the above described various prior art, there are problems as follows.

The first problem is that the applied film of surface of the photosensitive drum which applied film is important for forming an electrostatic latent image is chipped because the braking member directly contacts with pressure the surface of the photosensitive drum itself.

The second problem is that noise occurs because chipped powder of the applied film enters between the surface of the photosensitive drum and the braking member, causing frictional resistance and vibration occurs because the coefficient of friction of the braking member is high, or frictional vibration between same kind of material occurs.

The third problem is that mounting space of the braking member should be ensured with the exception of the photosensitive drum assembly because the braking mechanism has a complicated structure and braking is implemented from the outside of the photosensitive drum.

The fourth problem is that contact of development device to the photosensitive drum becomes inhomogeneous. Because pressing direction of the braking member aims at the direction which deflect the photosensitive drum in particular direction.

The fifth problem is that the productivity is poor because the braking mechanism is not mounted in a simple structure.

SUMMARY OF THE INVENTION

In view of the foregoing, it is one object of the present invention for solving the above-mentioned problems to provide a PC-cartridge of an image formation apparatus in which an applied film of the surface of the photosensitive drum is not chipped by the action of the braking mechanism.

It is another object of the invention to provide a PC-cartridge of an image formation apparatus in which noise caused by the braking mechanism does not occur.

It is further object of the invention to provide a PC-cartridge of an image formation apparatus whose braking structure is simple.

It is still further object of the invention to provide a PC-cartridge of an image formation apparatus whose photosensitive drum does not deflect in a particular direction.

It is another object of the invention to provide a PC-cartridge of an image formation apparatus whose PC-cartridge has good productivity.

According to one aspect of the present invention, for achieving the above-mentioned objects, there is provided an electrophotographic (PC)-cartridge of an image formation apparatus which utilizes electrophotographic process, comprises a photosensitive drum for forming electrostatic latent image thereon having a drum gear and a flange provided at both end section of the photosensitive drum, an inner peripheral section which is formed on either the drum gear or the flange, a braking mechanism for braking rotation of the photosensitive drum, and a braking member provided for the braking mechanism, wherein it causes the braking member to contact with the inner peripheral section.

As a result of this design, the applied film on the surface of the photosensitive drum is not chipped therefrom, and the noise does not occur. Further, it is not necessary to ensure large space for the braking mechanism at outside of the photosensitive drum.

In another aspect, a position for positioning the braking mechanism is set to a center shaft of rotation of the photosensitive drum. There is obtained the structure in which the photosensitive drum is not biased in particular direction.

In the further aspect, the PC-cartridge of the image formation apparatus is provided with a rib section, a flange section, or both sections at the part of the braking mechanism. Thereby, it is capable of preventing slipping off of the braking member.

In the still further aspect, the PC-cartridge of the image formation apparatus in which it causes the braking mechanism to mount on either the drum gear or the flange, or it causes the braking mechanism to mount on both end section of the photosensitive drum. Thereby, necessary braking force is ensured sufficiently.

Furthermore, the PC-cartridge of the image formation apparatus of the another aspect in which an inner peripheral section (whole periphery) of either the drum gear or the flange provided at the end section of the photosensitive drum forms in tapered shape which is spread in the direction of outside. Thereby, the braking mechanism is assembled into the photosensitive drum easily.

Moreover, the PC-cartridge of the image formation apparatus of the another aspect in which the portion which enters into the inner peripheral section of either the drum gear or the flange of the braking mechanism forms in tapered shape which narrows down in the direction of the photosensitive drum. Thereby, the braking mechanism is assembled into the photosensitive drum easily.

Moreover, the PC-cartridge of the image formation apparatus of the another aspect in which there is mounted a spring for energizing the braking mechanism in the direction of the shaft of the photosensitive drum, thereby, there is always obtained the stable braking force.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the invention will now be described in detail referring to the accompanying drawings.

Figure 1:
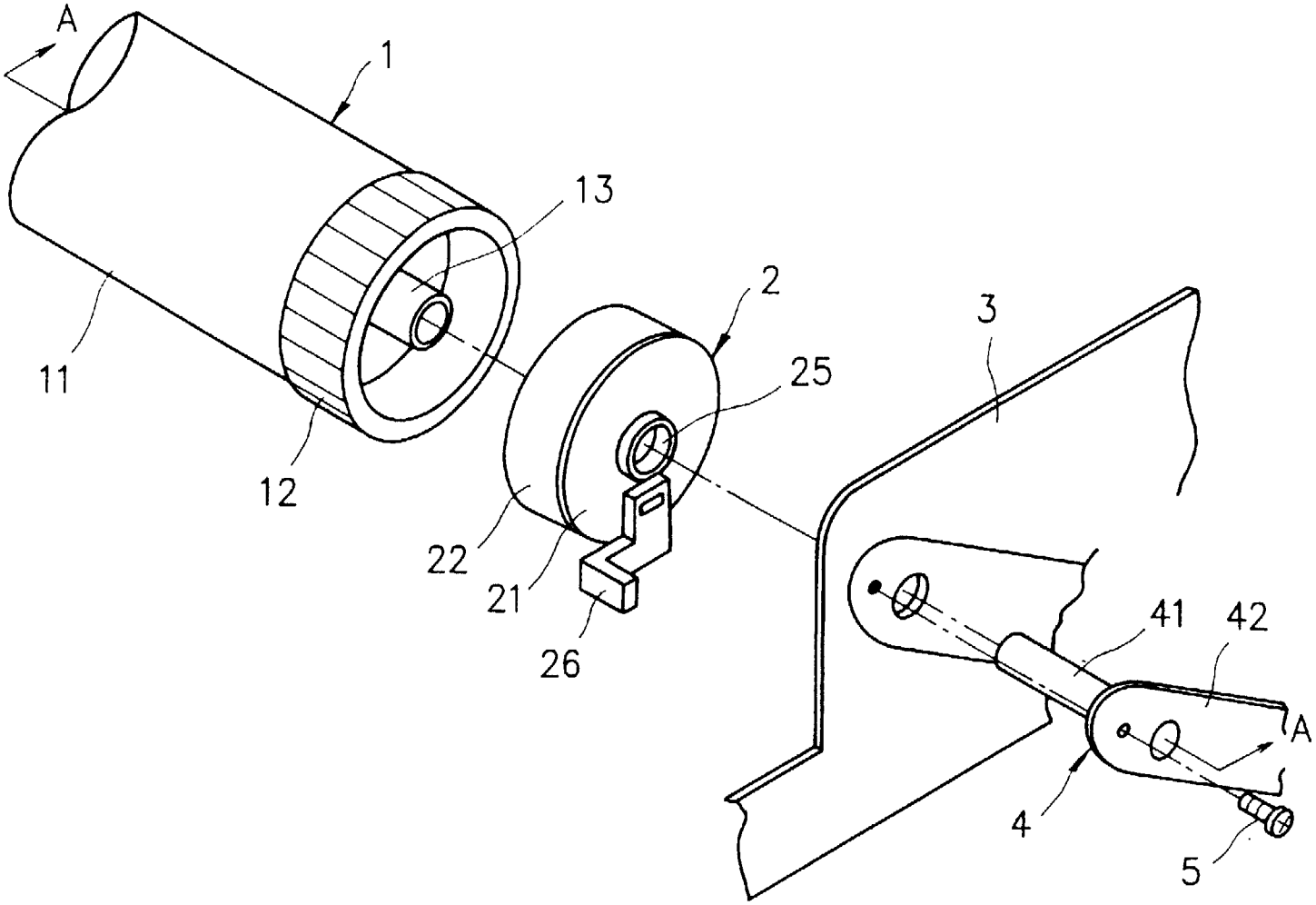
FIG. 1 is an exploded perspective view showing a first embodiment of a PC-cartridge of an image formation apparatus.

FIG. 1 is an exploded perspective view showing a first embodiment of the present invention.

Referring to FIG. 1, a photosensitive drum assembly 1 is provided with a drum gear 12 at one end of a photosensitive drum 11, and is provided with a flange (not illustrated) at the other end thereof. The photosensitive drum 11, the drum gear 12, and the flange (not illustrated) are integrated with one another to be rotated in a body. The drum gear 12 is made of synthetic resin, at inside of the gear 12, a part of the wall is removed to form the shape of cylindrical concavity into which a braking mechanism 2 is mounted. A bearing section 13 receives a shaft 41 at the center of rotation. Another bearing section is formed on the flange at the other end of the photosensitive drum 11.

The drum gear 12 is integrated with the photosensitive drum assembly 1 to be rotated by a drive due to a drive gear (not illustrated).

The braking mechanism 2 comprises a braking member 22 and a retaining member 21 for retaining the braking member 22. The braking member 22 is composed of felt (nonwoven fabric) and suede shaped surface material, and is glued to the retaining member 21 formed by synthetic resin. A portion of the retaining member 21 retains the braking member 22 which portion has cylindrical shape onto which a cap is attached. A positioning section 25 for positioning the retaining member 21 by the shaft 41 is formed at the center of the cap shaped section of the retaining member 21. Further, a protruded stopper section 26 is formed at the cap shaped section of the retaining member 21 and prevents the braking mechanism 2 from rotating with the photosensitive drum assembly 1 is formed at the cap shaped section of the retaining member 21.

The braking mechanism 2 is assembled on the inside of the cylindrical shaped concavity of the drum gear 12 of the photosensitive drum assembly 1, and is contained on the inside of a cartridge case 3 in company with the photosensitive drum assembly 1. The outer peripheral surface of the braking member 22 of the braking mechanism 2 contacts the peripheral surface of the inner cylindrical shape of the drum gear 12 of the photosensitive drum assembly 1 with pressure and is thus capable of braking the photosensitive drum assembly 1. Further, the applied film on the outer periphery of photosensitive drum 11 is not chipped by the braking mechanism 2.

A fixed shaft 4 inserts from the outside of the cartridge case 3 fastened to the cartridge case 3 by a screw 5, protruded stopper section 26 touches to the cartridge case 3 from the side surface thereof.

The fixed shaft 4 is composed of a metallic shaft 41 and a retaining plate 42 which is made of either metal or synthetic resin. The center of the cylinder of the photosensitive drum assembly 1 as well as the braking mechanism 2 is positioned on the same shaft (shaft 41) due to the fixed shaft 4.

Although the photosensitive drum assembly 1 is rotated by the drive of the above stated drive gear (not illustrated) through the drum gear 12, the braking mechanism 2 is prevented from rotating with the photosensitive drum assembly 1 by the protruded stopper section 26, which touches the side surface of the cartridge case 3 in the lateral direction. Thus, the inner peripheral surface of the cylindrical shape of the drum gear 12 and the outer peripheral surface of the braking member 22 of the braking mechanism 2 are fictionally slid, so rotation of the photosensitive drum assembly 1 is capable of being braked, and unevenness of rotation can be reduced.

Figure 2:
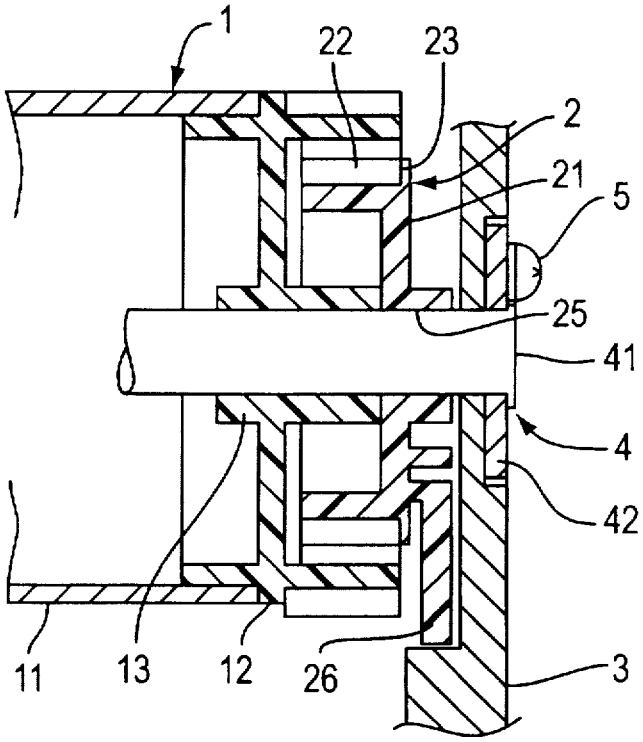
FIG. 2 is a sectional view cutting along A—A line in the case of assembling of the PC-cartridge of FIG. 1.

FIG. 2 is a sectional view along line A—A of FIG. 1. Referring to FIG. 2, in the photosensitive drum assembly 1, end portion of the drum gear 12 is entered into the inside of the end section of the photosensitive drum 11 to be mounted. The braking mechanism 2 is entered into inside of cylindrical shape of the drum gear 12 to be assembled. At this time, the thickness in the radius direction of the braking member 22 of the braking mechanism 2 is compacted by approximately of the order of 0.2 to 0.8 mm.

Above described bearing section 13 is provided at the center of the cylindrical shape of the drum gear 12. A flange section 23 is provided at a portion which is contacted with the side surface of the braking member 22 at the cap shaped section of the retaining member 21 of the braking mechanism 2. The positioning section 25 of the braking mechanism 2 is positioned at center of the cap shaped section of the retaining member 21, and also is positioned at the center of the cylindrical shape which retains the braking member 22.

The photosensitive drum assembly 1 and the braking mechanism 2 are arranged on the same shaft (shaft 41), with the shaft 41 as a center. Thereby, the photosensitive drum 1 is not deflected in the particular direction.

Figure 3:
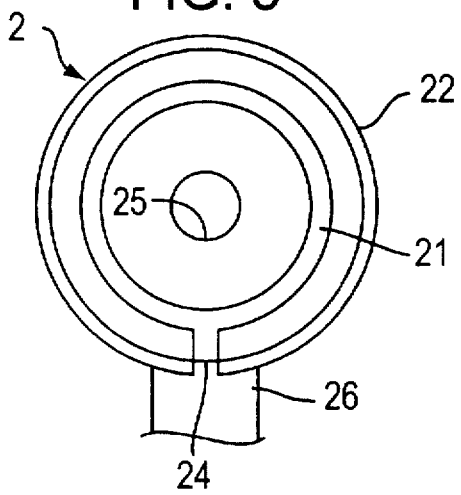
FIG. 3 a plan view showing a braking mechanism section of the PC-cartridge of FIG. 1.

FIG. 3 is a plan view showing the braking mechanism 2 viewed from the photosensitive drum assembly 1. Referring to FIG. 3, a portion which retains the braking member 22 of the retaining member 21 of the braking mechanism 2 is cylindrical shape, there is the positioning section 25 at the center of the cylindrical shaped section, and rib section 24 is formed such that the rib section 24 is contacted with the end portion of the braking member 22.

The constitutions shown in FIGS. 1 to 3 are not necessarily restricted to the side of the drum gear 12. They could also be provided at the side flange mounted on the other end of the photosensitive drum constitutions exist even on both sides thereof.

Next, a second embodiment of the present invention will be described referring to the sectional view in FIG. 4. Fundamentally the elements are the same as that of the above described first embodiment, with the exception of the following differences, which will be described in detail.

Figure 4:
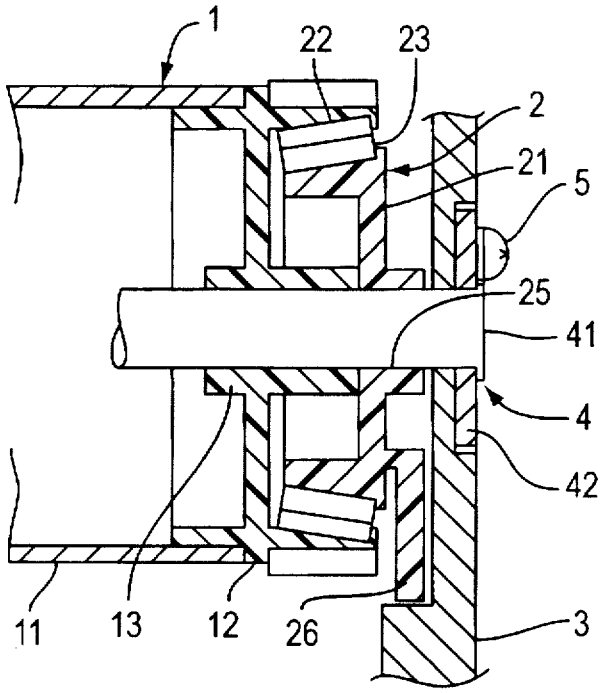
FIG. 4 is a sectional view showing a second embodiment of the present invention.

Referring to FIG. 4, inner peripheral section of cylindrical shaped section of the drum gear 12 mounted on the photosensitive drum assembly 1 has a tapered shape which spreads in the direction of the outside. The other cylindrical shaped section which retains the braking member 22 of the retaining member 21 of the braking mechanism 2, forms a tapered shape which narrows down in the direction of the drum gear 12. The other cylindrical shaped section is opposite to the tapered section of the drum gear 12. Such construction allows for easy insertion of the braking mechanism 2 into the drum gear 12.

Next, a third embodiment of the present invention will be described referring to the sectional view in FIG. 5. Fundamentally the elements are the same as that of the above described second embodiment, with the exception of the following differences, which will now be explained.

Figure 5:
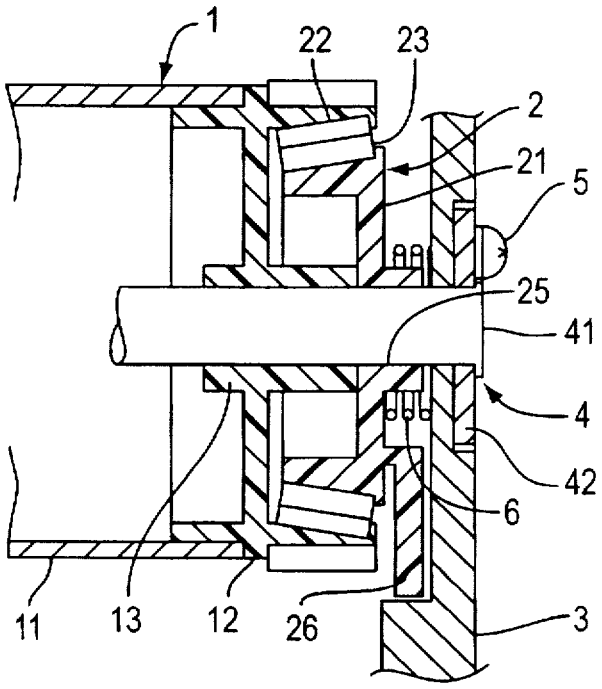
FIG. 5 is a third embodiment of the present invention.

Referring to FIG. 5, a compression spring 6 is assembled between the braking mechanism 2 and the cartridge case 3. The spring 6 comes into contact with the retaining member 21 of the braking mechanism 2 and is mounted so as to push the braking mechanism 2 in the direction of the photosensitive drum assembly 1. Thus, the braking member 22 of the braking mechanism 2 contacts the inner peripheral section of the drum gear 12 pressure even if the dimension of a diameter of the inner peripheral section of the drum gear 12 or the diameter of outer peripheral section of the braking mechanism 2 is dispersed. Further, even if the inner peripheral the outer peripheral section of the braking member 22 wears to bring somewhat of change of the diameter, thus conforming thereto, with the result that the braking member 22 of the braking mechanism 2 can be contacted continuously with the inner peripheral section of the drum gear 12 with pressure, thus a stabilized braking effect can be obtained.

Here, detailed matter will be described.

The braking member 22 shown in FIGS. 1 to 5 is made of felt (nonwoven fabric) as a fundamental material, and suede shaped material arranged on the surface thereof. Thickness of the braking member 22 is 3 mm. The material of the member can be generally obtained, which material is made by FUJI BOUSEKI Co., Ltd. whose material name is P. SUEDE BM4301 (3.0), density is approximately 0.35 g/cm$^3$, compression ratio is approximately 10.2%, compression elastic ratio is approximately 87.6%, and hardness is approximately 50 degree.

The drum gear 12 and the flange (not illustrated) are made of polyacetal. The retaining member 21 is made of acrylonitrile-butadiene-styrene (ABS).

An adhesive for ABS is used for gluing the braking member 22 to the retaining member 21, thus the braking member 22 is stably glued more than double-sided tape. At this case, although it is unnecessary to provide the rib section 24 on the retaining member 21, when the braking member 22 is glued to the retaining member 21 by the double-sided tape, it is necessary to provide the rib section 24 for preventing slipping off of the braking member 22. Further, the flange section 23 of the retaining member 21 causes the braking member 22 to glue easily, and prevents slipping off of the braking member 22 when the braking member 22 is inserted into the drum gear 12. It is capable of preventing rubbish or dust from entering into the pressure-contacted section between the braking member 22 and the drum gear 12 due to the fact that it causes the flange section 23 to broaden so as not to contact the drum gear 12.

It need scarcely be said that it is capable of carrying out the above described matter as for the flange (not illustrated) which is mounted on the opposite side of the drum gear 12 in terms of the photosensitive drum assembly 1.

As stated above, the PC-cartridge of the image formation apparatus according to the present invention brings the following effects.

The first effect is that the applied film of the surface of the photosensitive drum is not chipped by the action of the braking mechanism because the braking mechanism is assembled so as to contact the drum gear provided at the end section of the photosensitive drum or inner peripheral section (about whole peripheral section) of the flange with the braking member.

The second effect is that no noise occurs because the braking mechanism is assembled so as to contact the drum gear provided at the end section of the photosensitive drum or inner peripheral section (about whole peripheral section) of the flange with the braking member.

The third effect is that it is unnecessary to ensure large space for the braking mechanism at the outside of the photosensitive drum assembly because the braking mechanism is assembled so as to contact the drum gear provided at the end section of the photosensitive drum or inner peripheral section (about whole peripheral section) of the flange with the braking member.

The fourth effect is that this construction prevents the photosensitive from deflecting in a particular direction, with the result that printing quality can be kept excellently, because it causes the positioning point of the braking mechanism to agree with rotational center shaft of the photosensitive drum.

The fifth effect of the present invention is that it is capable of preventing the braking member from slipping off. Because the rib section or the flange section or both sections for stopping movement of the braking member is provided at the part of the braking mechanism.

The sixth effect of the present invention is that it is capable of ensuring necessary braking power sufficiently because the braking mechanism is mounted on either the drum gear or the flange or on both which are provided at both end sections of the photosensitive drum.

The seventh effect of the present invention is that the braking mechanism is easily assembled into the photosensitive drum assembly because the inner peripheral section (about whole peripheral section) of the drum gear or the flange provided at the end section of the photosensitive drum forms a tapered shape which is spread in the direction of the outside, and the part which enters into the inner peripheral section of the drum gear or the flange of the braking mechanism forms in the tapered shape which narrows down in the direction of the photosensitive drum.

The eighth effect of the present invention is that it is capable of obtaining always stable braking power because the spring for energizing the braking mechanism in the direction of the shaft of the photosensitive drum is mounted.

While preferred embodiments of the invention have been described using specific terms, such description is for illustrative purpose only, and it is to be understood that changes and variations may be made without departing from the spirit or the scope of the following claims.

What is claimed is:

1. An electrophotographic cartridge of an image formation apparatus which utilizes an electrophotographic process, said electrophotographic cartridge comprising:

a photosensitive drum for forming an electrostatic latent image thereon, said drum having a drum gear provided at one end section and a flange provided at another end section;

an inner peripheral section which is formed on one or both of said drum gear and said flange; and a braking mechanism for braking rotation of said photosensitive drum, said braking mechanism comprising:

a retaining member; and a braking member retained by said retaining member and contacting said inner peripheral section, wherein said retaining member includes one of a rib section and a flange section for preventing slipping off of said braking member.

2. An electrophotographic cartridge of an image formation apparatus which utilizes electrophotographic process, said electrophotographic cartridge comprising:

a photosensitive drum for forming an electrostatic latent image thereon, said drum having a drum gear provided at one end section and a flange provided at another end section;

an inner peripheral section which is formed on one or both of said drum gear and said flange; and a braking mechanism for braking rotation of said photosensitive drum, said braking mechanism comprising a braking member contacting said inner peripheral section, wherein said inner peripheral section has a tapered shape in a direction along a longitudinal axis of said photosensitive drum.

3. The electrophotographic cartridge as claimed in claim 2, wherein a part of said braking mechanism has a tapered shape to mate with the tapered shape of said inner peripheral section.

4. The electrophotographic cartridge as claimed in claim 3, further comprising a spring that biases said braking mechanism toward said photosensitive drum.

* * * * *